United States Patent [19]

Giulie et al.

[11] 3,952,356

[45] Apr. 27, 1976

[54] GAUGE AND ALIGNMENT DEVICE FOR ATTACHING COVERS TO BOOKS

[75] Inventors: Joe D. Giulie; Leslie E. Worcester, both of Palo Alto, Calif.

[73] Assignee: Minnesota Mining & Manufacturing Company, St. Paul, Minn.

[22] Filed: Feb. 21, 1975

[21] Appl. No.: 551,752

[52] U.S. Cl. ..... 11/3

[51] Int. Cl. ..... B42c 11/00

[58] Field of Search ..... 11/1, 3; 281/21

[56] References Cited

UNITED STATES PATENTS 3,749,423 7/1973 Abilgaard et al. ..... 281/21

3,825,964 7/1974 Groswith et al. ..... 11/3

*Primary Examiner*—Lawrence Charles

*Attorney, Agent, or Firm*—Alexander, Sell, Steldt & DeLaHunt

[57] ABSTRACT

A gauge and alignment device is provided for applying a hard cover to a bound sheaf of paper. The device serves both as a gauge to determine the proper size of cover to use for a given volume as well as an arcuate alignment device so that the material to be bound can be applied squarely in the center of the cover.

7 Claims, 9 Drawing Figures

GAUGE AND ALIGNMENT DEVICE FOR ATTACHING COVERS TO BOOKS

BACKGROUND OF THE INVENTION

1. Field of the Invention

Gauge and alignment device for applying a cover or backing to a sheaf of bound paper.

2. Description of the Prior Art

The closest known prior art patents are U.S. Pat. Nos. 3,825,963 and 3,825,964. These patents describe cover alignment devices wherein a sheaf of paper is gripped between two members which can be moved toward and away from each other by means of screws on the ends of a shaft wherein the screws are of opposite hands. An edge guide is employed which can be moved manually from one position to another or which can be moved in and out by means of a pinion which operates against a pair of opposed racks moving the end guides in opposite directions. The device of the present invention is much simpler and easier to use than these devices since it is only necessary in the present invention to place the sheaf of paper to be bound within a gauge to determine the proper size of cover and then to move a lever against the sheaf of paper to set the edge guide.

SUMMARY OF THE INVENTION

The present invention relates to a gauge and alignment device for applying covers to a sheaf of paper which has previously been bound in some manner. The invention was particularly designed for applying covers to a sheaf of paper which has been previously bound utilizing binding elements of the type described and claimed in copending patent application Ser. No. 338,246 filed Aug. 13, 1973, of Joe D. Giulie and assigned to the common assignee of this application, and the invention will be described as applied to a sheaf of paper so bound. However, the invention is one of general applicability and can be used to apply a cover to a sheaf of paper which has been prebound in any manner, such as by the use of glue, staples, sewing, or the like.

Hard covers are available, such as those described in the copending patent application of Joe D. Giulie, Ser. No. 511,685, filed Oct. 3, 1974, and assigned to the common assignee of this application, wherein the cover has the usual front and back members connected together by means of a central spine with upstanding tabs on opposite sides of the spine, the tabs having a coating of pressure-sensitive material on each of the inner surfaces of the tabs. Such covers are made in a variety of sizes to fit volumes of different thicknesses. Ordinarily, one line of covers would have front and back members of uniform size, to fit volumes having a standard page size, but such covers would be made with spines in a variety of widths so that one could select a spine width approximating the thickness of the material to be bound. Obviously, it would be impossible to make such covers to fit every gradation of thicknesses so that such covers are ordinarily made with spines which vary in width by some incremental amount such as one-fourth inch.

One first selects a cover having a suitable width of spine for the thickness of the material to be bound and ideally the spine would have the exact width of the thickness but it is obvious that ordinarily one must select a cover having a spine slightly wider than that actually required. By placing the material to be bound in a cover slightly larger than that required, a neat result is still obtained if the material to be bound is precisely centered on the spine. It is equally obvious that one cannot select a cover which is too small since it would be impossible to insert the material to be bound within the limits of the upstanding pressure-sensitive strips.

Thus, there are two problems in applying such covers to bound materials, namely, first selecting a cover which is just large enough, or slightly larger than required, from a stock of covers which come in various fixed increments. Secondly, after one has selected such a cover, the next problem is to center the material to be bound on the spine with extreme accuracy so that a neat, professional appearance will be obtained in the bound volume. The device of the present invention combines both functions so that it is easy to select a cover of suitable size and, having selected a suitable cover, it is easy to center the material to be bound on the cover.

Generally speaking, the objects of the present invention are achieved by providing a gauge having a series of steps so that one can first place the material to be bound within the confines of the gauge to determine the required cover size. Having arrived at the proper cover size, one now moves a lever to engage the material to be bound within the gauge and this automatically moves a centering device so that the cover can be placed properly within the aligner; it will be precisely positioned so that when the material to be bound is placed on the alignment device, it will be accurately centered on the cover.

In general, the objects of the present invention are achieved by providing a step-like gauge which in one position enables one to select the cover and which when moved to a second position to engage the material to be bound has a 2-to-1 movement ratio to provide a side stop for properly positioning the cover in the alignment jig.

Although in the specification which follows, two embodiments of the device are shown which superficially are quite dissimilar, the mechanical functioning of the two devices is precisely the same.

DESCRIPTION OF THE PREFERRED EMBODIMENTS

Figure 1:
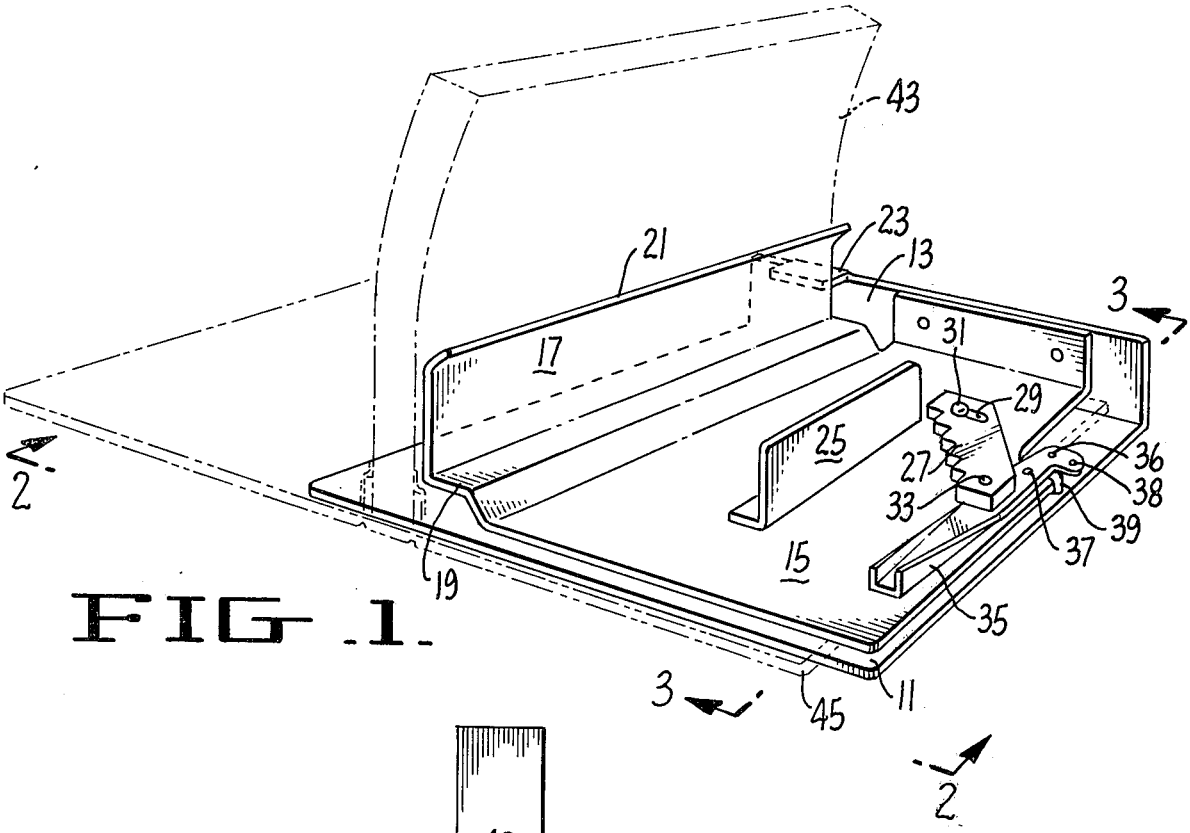
FIG. 1 is a perspective view of a cover alignment device embodying the present invention.
Figure 2:
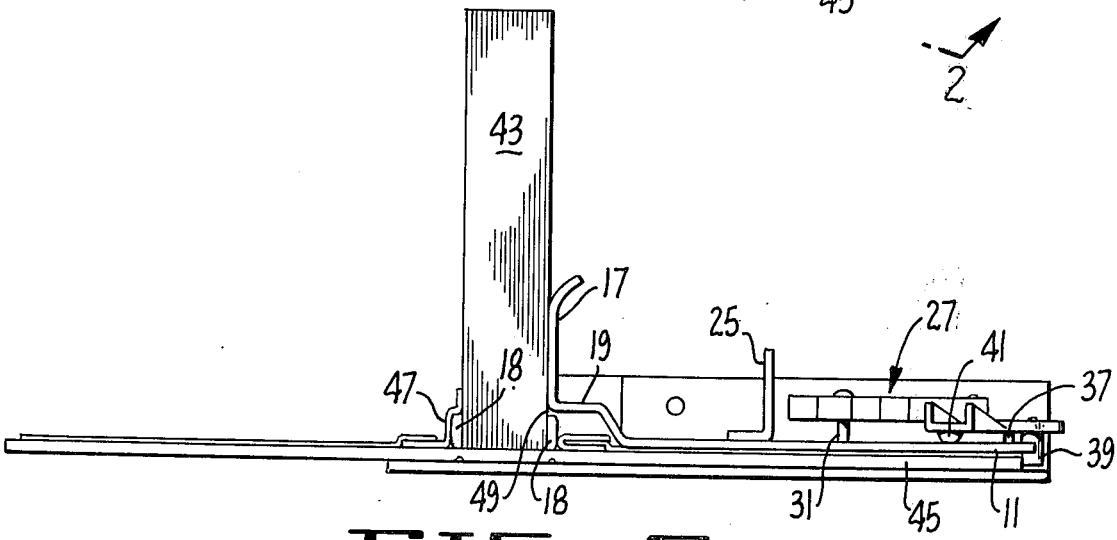
FIG. 2 is an end view on the line 2—2 of FIG. 1.
Figure 3:
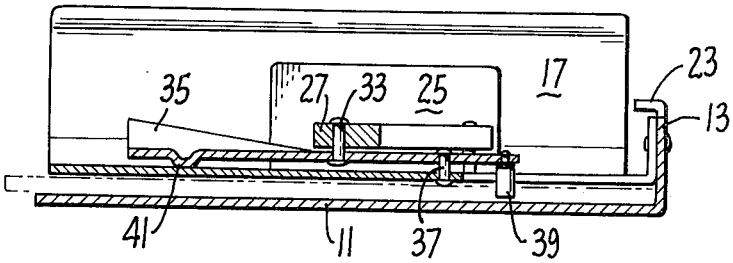
FIG. 3 is a side sectional view on the line 3—3 of FIG. 1.
Figure 4:
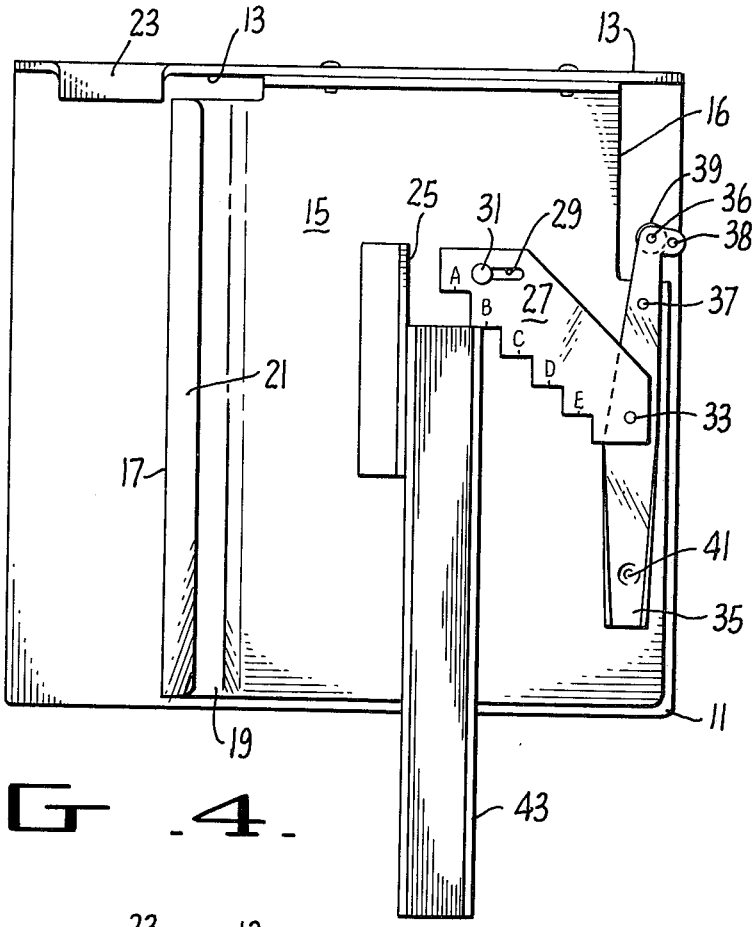
FIG. 4 is a plan view of the device shown in FIG. 1 showing its function as a gauge to determine the proper cover size to employ.

Referring now to the drawings by reference characters, and specifically to FIGS. 1 through 5, the device of the present invention includes a base plate 11 which is of generally flat configuration and which is adapted to hold an opened cover which is to be applied to a book. At one end the base plate is turned up at a right angle to provide a ledge 13 which serves as a guide for the top of the cover as well as a support for the upper plate 15. Plate 15 is parallel to and spaced slightly above plate 11 to allow a cover to be inserted between the plates. Plate 15 has an upstanding edge 17 which is used as an alignment plate against which to place the material to be bound as is later explained. Since many binding methods provide binding spines 18 which lie along one marginal edge of the volume, the plate 17 may have a raised portion 19 to provide clearance for the binding spine. The top edge of the plate 17 may be turned over slightly as at 21 to facilitate the placement of material to be bound. The turned over edge 21 also serves to stiffen plate 17. Ledge 13 also carries an inturned end stop 23 to position the material to be bound with respect to the top and bottom of the cover member. Mounted on the upper plate 15 is a fixed gauge stop 25 and mounted in proximity to this is the movable gauge plate 27. The movable plate 27 has a slot 29 and a rivet 31 passes through the slot and the rivet attached to plate 15. The opposite end of the movable gauge plate 27 is pivoted by rivet 33 to a lever arm 35 which in turn is pivoted by a rivet 37 to plate 15. The amount of movement permitted by the slot 29 is relatively small. The movable plate 27 moves substantially forward and back at right angles to the gauge stop 25 as lever 35 is moved. The movable gauge plate 27 has a series of steps thereon such as those designated A, B, . . . E in FIGS. 4 and 5. These steps correspond in depth (i.e., in distance from fixed stop 25) by the increments in which the spines of the covers are manufactured. In other words, if the covers are manufactured in steps of one-fourth inch, the steps on the movable plate 27 would differ by one-fourth inch.

The lever arm 35 carries a cover alignment pin 39 at its distal end, i.e., beyond pivot 37. Pin 39 may be fixed on lever arm 35 but preferably two holes, 36 and 38, are provided so that the pin may be moved from one hole to the other to accommodate covers of two different sizes. In the drawings, pin 39 is in hole 36. Obviously, more than two holes could be provided to accommodate a variety of cover sizes. The distance from rivet 33 to the pivot 37 is exactly twice the distance from pivot 37 to pin 39 and this critical relationship will be brought out later in detail. Plate 15 is cut away as at 16 so that pin 39 can extend down below plate 15 and it just clears plate 11. The arm 35 has a dimple 41 which rubs against plate 15 so that arm 35 will tend to stay in any position where it is placed, yet it can readily be moved to a new position when desired.

Figure 5:
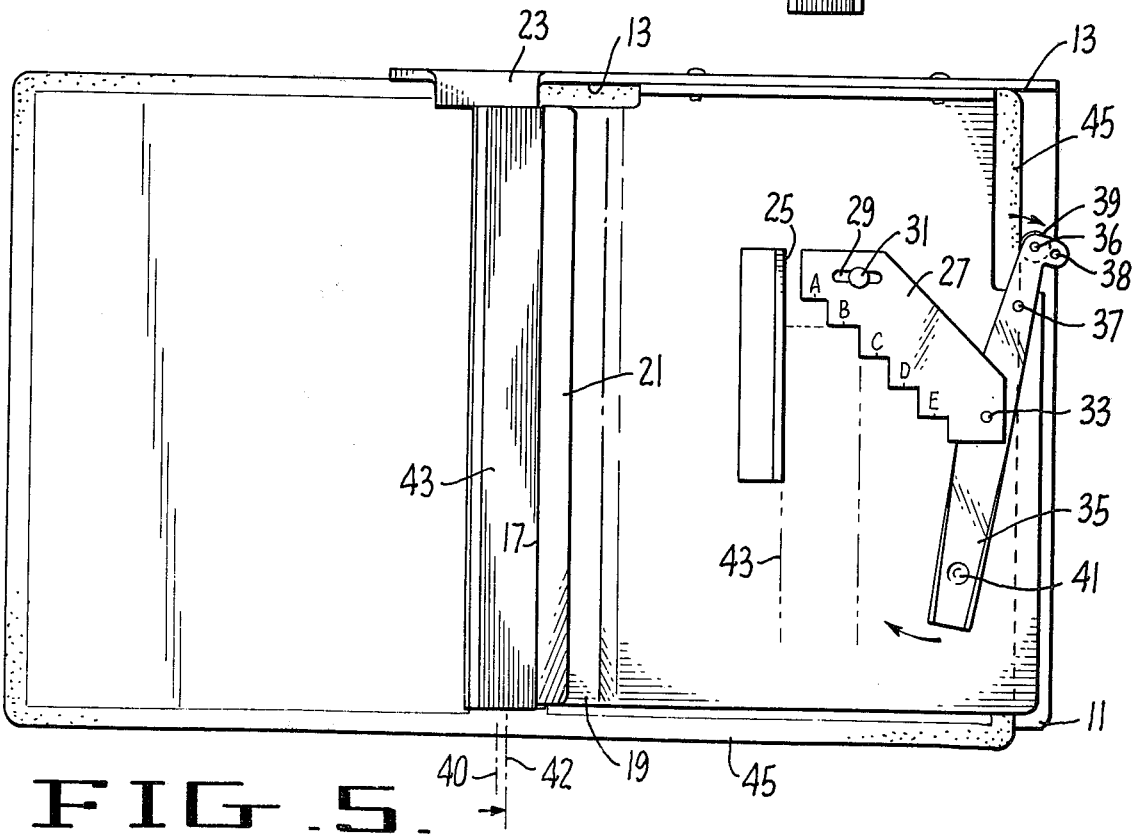
FIG. 5 is a plan view, similar to FIG. 4, showing the position of the parts when the deivce is used to position a cover within the alignment jig.
Figure 6:
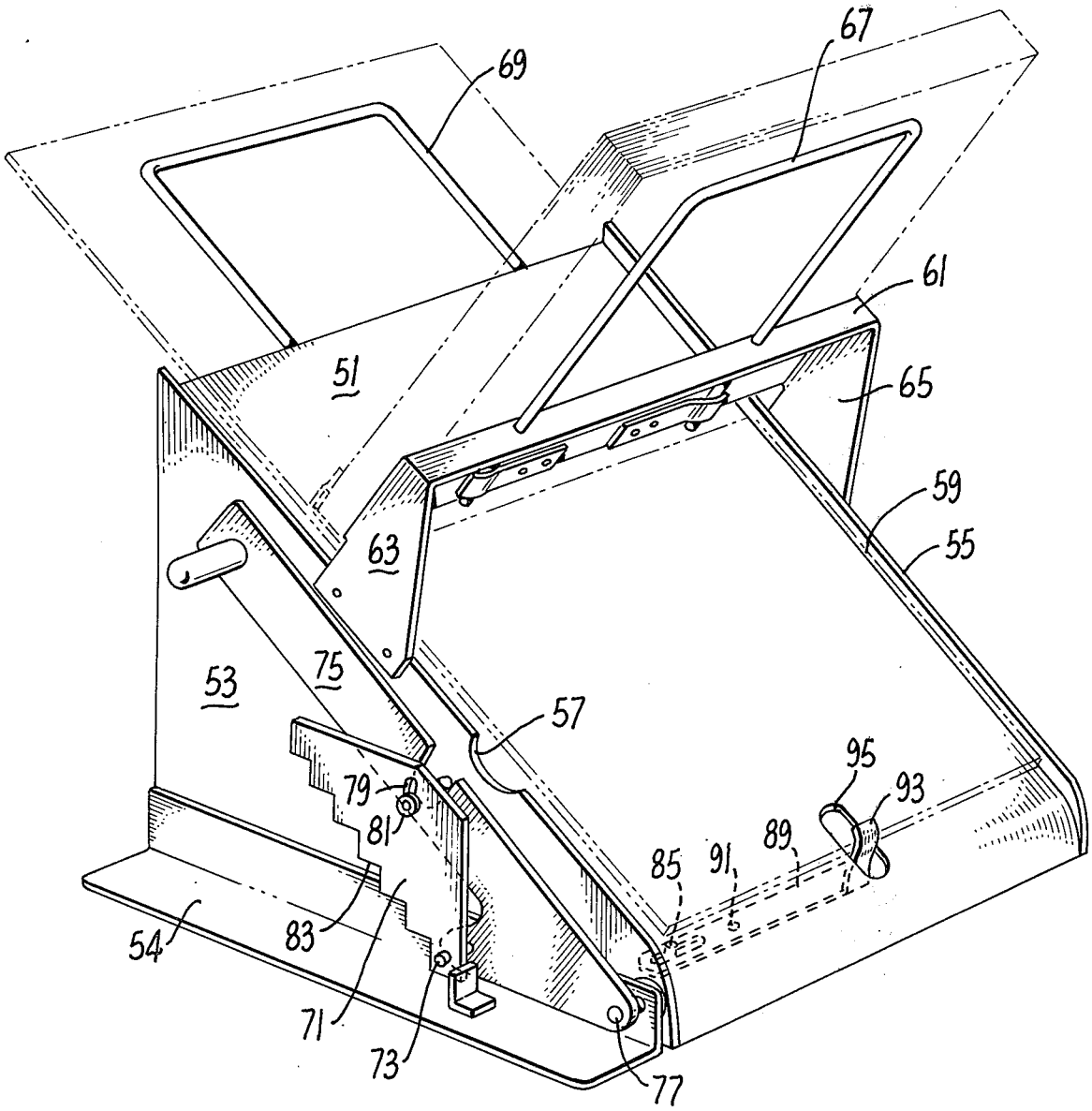
FIG. 6 is a perspective view of another embodiment of the invention.
Figure 8:
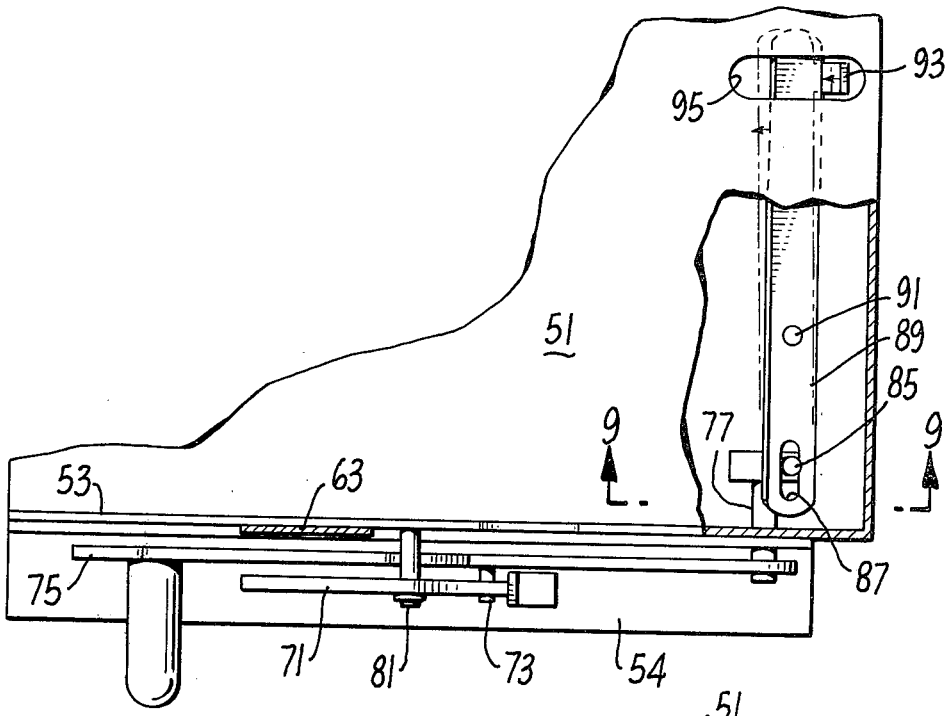
FIG. 8 is a partial sectional plan view of the gauging and alignment mechanism.
Figure 9:
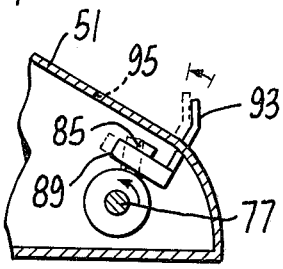
FIG. 9 is a partial sectional view of the line 9—9 of FIG. 8.

In use, lever 35 is moved to the right as far as possible so that the pin 31 is in the extreme left-hand portion of slot 29. One now places a sheaf of paper 43 between fixed gauge stop 25 and the smallest step on movable gauge plate 27 which will accommodate the sheaf of paper, and notes the reading. In the example shown in FIG. 4, the size B is selected since this is the smallest space which will accommodate the sheaf 43. One now moves the lever 35 to the left as is shown in FIG. 5 until the notch B in plate 27 engages the material to be bound and presses it gently against stop 25. It will be recalled that the distance from 33 to pivot 37 is exactly twice that of the distance between pivot 37 and cover alignment pin 39 so that pin 39 will move to the right by exactly half the distance which plate 27 has moved to the left. This positions the stop pin in exactly the right place to center the material to be bound on the spine of the cover. Thus, the centerline of the spine will be displaced from line 40 to line 42 when the cover is ultimately put into place. One now takes a size B cover from stock which in this case is designated 45. One now passes the right-hand leaf of the cover 45 between plates 11 and 15 pushing it back against the upturned edge 13 and to the right so that it is against pin 39. The material to be bound is placed flush along the side of plate 17 and against stop 23. Thus, the material to be bound is in the position as shown in phantom in FIG. 1 and in solid lines in FIG. 2. Now one removes the protective paper from the pressure-sensitive left-hand strip 47 of the cover and presses it against the material to be bound 43. The cover and the material to be bound are now accurately aligned so that the assembly can be removed from the alignment jig and the right-hand pressure-sensitive strip 49 pressed into place. This completes the cover application to the document to be bound.

Referring now to that embodiment of the invention shown in FIGS. 6 through 9, the gauge and alignment device includes a table 51 which is supported at a convenient angle for work by the side walls 53 and 55. These walls extend above the level of table 51, forming ledges 57 and 59 which serve as side guides for the cover. The document alignment plate 61 is suspended over table 51 by brackets 63 and 65. To facilitate handling documents, a detachable extension 67 may be provided on the document alignment plate 61 while a similar extension 69 can be provided at the end of the table.

In this embodiment of the invention, the movable gauge plate 71 is pivoted by rivet 73 on handle 75. The handle 75 in turn is fastened to shaft 77 which is mounted for rotation on side plate 53. The gauge plate 71 has a slot 79 therein and a rivet 81 extends through the slot and is fastened to the side wall 53 so that as handle 75 is raised and lowered, the movement of gauge plate 71 is substantially vertical and shaft 77 is caused to rotate. The gauge plate has a series of steps 83 as previously described in connection with gauge plate 27. Ledge 54 which extends from side plate 53 serves as a fixed gauge stop.

Shaft 77 which is mounted for rotation on side wall 53 as previously described, has a pin 85 which extends upwardly under the table 51. Pin 85 fits in a slot 87 in lever arm 89 which is pivoted at 91. The distal end of the lever arm has an upwardly extending alignment pin 93 which extends through a hole 95 in the table 51. Here again, the dimensions are such that as gauge 71 goes up and down by a given distance, pin 93 will move back and forth by exactly half this distance.

Figure 7:
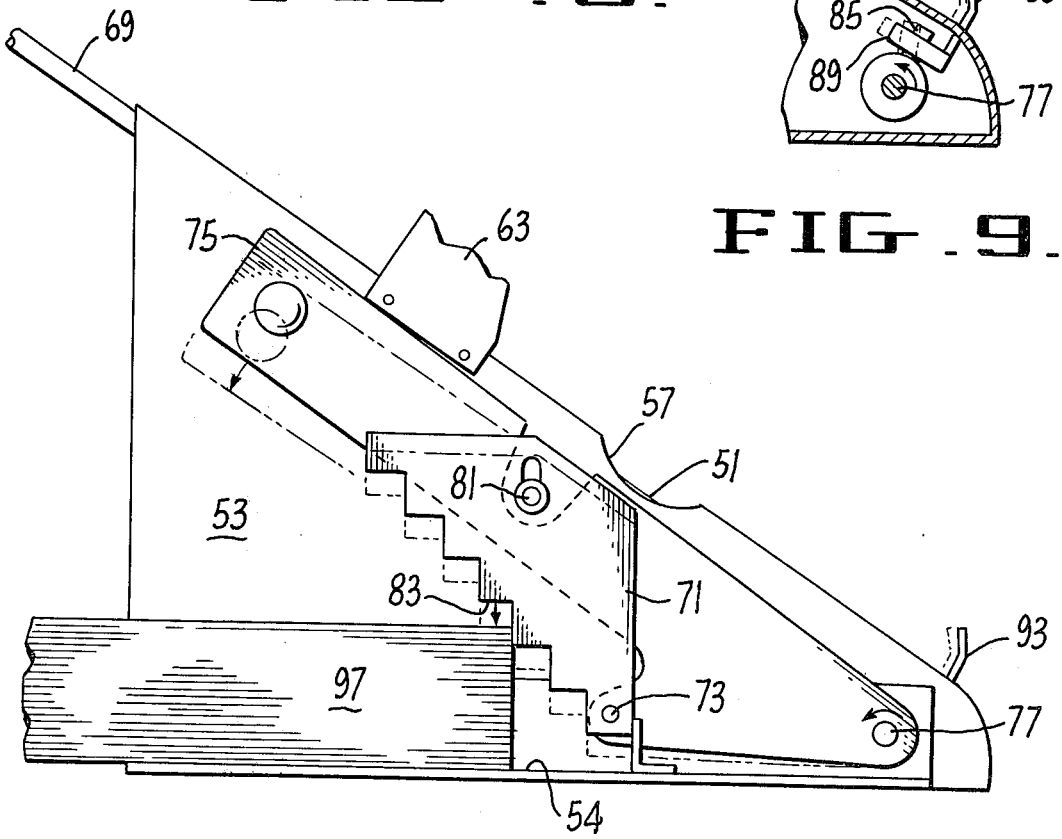
FIG. 7 is a partial side view of the device shown in FIG. 6 showing the movement of the parts.

The operation of the device is substantially the same as was described in connection with the first embodiment of the machine. With particular reference to FIG. 7, one first places a document 97 to be bound under the gauge plate 71 with handle 75 in its uppermost position. One now selects the proper size cover depending on which notch the document fits into. Handle 75 is now pushed downwardly as is shown in dot/dash lines in FIG. 7 until the plate 71 engages the document. This will have moved pin 93 by the proper distance to center the spine of the cover on the document. One selects a cover of proper size and inserts it on the table as is shown in dot/dash lines in FIG. 6 where it is accurately located by the edges 57 and 59 as well as the gauge pin 93. Leaving the handle in position, one now removes the document from the gauge plate and places it against the document alignment plate 61. One now has the cover and the document accurately aligned and one attaches the cover to the document in the manner previously described.

Although two specific embodiments of the invention have been shown as well as specific mechanical linkages, it will be obvious to those skilled in the art that many variations can be made in the exact structure and linkages shown without departing from the spirit of this invention.

The device of the present invention has been described in conjunction with a specific hard cover having pressure-sensitive tabs on either side of a central spine. It is obvious that the device of the present invention can be used in any instance wherein it is desired to select a cover of approximately the correct size and then precisely center a document to be bound on the cover.

What is claimed is:

1. A device providing a combined cover alignment gauge for selecting a cover of a proper size to fit a given document and a cover alignment jig whereby a prebound document to be covered can be centered on a cover of the selected size, said device being for use with prefabricated covers having front and back members of uniform size to accommodate pages of a given size, said front and back members being flexibly connected through a central spine member, said spine member being manufactured in a variety of width increments to accommodate documents of various thicknesses, said prefabricated covers having attachment means whereby said covers can be attached to a prebound document, said device comprising in combination:

a. a frame including a plate having a surface for supporting a cover, an alignment plate perpendicular to said surface, a fixed gauge stop member, and a movable gauge plate supported on said frame, and movable toward and away from said fixed gauge stop member, said gauge plate having a series of steps thereon in increments corresponding to the spine width appropriate for various documents to be bound and having indicia thereon to identify the individual steps, whereby a document can be placed between said fixed gauge stop and said movable gauge plate to permit proper selection of a cover sized for binding the document chosen, and b. means for movably mounting said gauge plate on said frame for engaging a chosen document between a step of the movable gauge plate and said fixed gauge stop and means for engaging a cover supported on said surface to position said cover with respect to said surface at a position related to the amount of movement of the gauge plate with respect to said fixed gauge stop for aligning the center of the cover at a spaced position from said alignment plate.

2. The device of claim 1 wherein a lever is provided for moving said movable gauge plate, said lever also actuating a pin which serves to locate said cover and linkage means whereby movement of said movable gauge plate by a given distance will move said pin by one half said distance.

3. The structure of claim 2 wherein said lever has a pivot point between the ends thereof and carries said gauge plate on one side of said pivot and said pin on the opposite side of said pivot, the distance from the pivot to the point of connection of said gauge plate being twice that of the distance of said pin to said gauge plate whereby movement of the lever moves the gauge plate in one direction and moves the pin in the opposite direction through half the distance.

4. The structure of claim 3 wherein said pin can be removably inserted in more than one position on said lever whereby covers of more than one size can be aligned on said jig by placing the pin in a selected position.

5. The structure of claim 1 wherein said frame includes a base adapted to be placed on a horizontal surface and supports said plate at an angle thereto whereby a document to be bound will be at least partly supported by said alignment plate.

6. A device for indicating the proper size for a cover to fit over a bound stack of standard sized sheets and for use in centering the bound stack of sheets on a cover of the indicated size, said device being adapted for use to select a said cover from prefabricated covers of various sizes each cover having front and back members of a uniform size, a spine member flexibly connected between the front and back members, and means for attaching the cover to a said stack of sheets with an edge surface of the stack of sheets adjacent the binding located along the spine member, said spine members in different sized covers being of different predetermined widths to accommodate bound stacks of sheets of a different range of thicknesses, said front member, back member and spine member of each cover having aligned edges defining generally straight longitudinal cover edges when said cover is in a flat open condition and said front and back members each having an end edge for said cover generally perpendicular to said longitudinal cover edges, said device comprising:

a frame including;

a plate having a support surface adapted for supporting a said cover in a flat open condition;

a ledge adapted for engaging and positioning one longitudinal edge of a said cover supported on said support surface; and an alignment plate having a generally planar guide surface adapted to engage a side surface of a said bound stack of sheets, said alignment plate being disposed transverse to said support surface with said guide surface normal to said support surface and the longitudinal edge of a said cover positioned against said ledge, and said alignment plate being spaced from said support surface to afford insertion of a said cover therebetween;

a pin adapted to engage and position one end edge of a said cover supported on said support surface, said pin being movably mounted on said frame to afford various positions of said pin relative to the guide surface of said alignment plate;

a gauge stop fixed to said frame and having a stop surface adapted for engaging one side surface of a said stack of sheets;

a gauge plate movably mounted on said frame and having a stepped side surface with first surface portions disposed generally normal to said stop surface and second surface portions positioned in opposed relationship to said stop surface, said gauge plate being adapted so that in a gauge position of said gauge plate the spacings between said stop surface and the opposed second surface portions of two successive steps in said side surface represents the range of thickness of a bound stack of sheets which can properly be received in a cover of one predetermined size, the gauge stop and gauge plate being adapted to receive the edge surface of a stack of sheets in a given range beside the second surface portion representing the maximum thickness of the given range and against the first surface portion extending from that second surface portion to the second surface portion representing the minimum thickness of the given range, said gauge plate being movable from said gauge position toward a centering position at which the stop surface and any one of the opposed second surface portions representing the maximum thickness for a stack of sheets having a thickness in the range received between that second surface portion and the stop surface will contact the opposite sides of a stack of sheets having a thickness in that range when it is positioned therebetween;

means for visually indicating the proper size of cover which may be properly used with a stack of sheets having a given thickness; and means coupled between said gauge plate and said pin for positioning said pin when the gauge plate is positioned at the center position for a said stack of sheets so that when a cover of the indicated proper size for the stack of sheets is positioned with one longitudinal edge against said ledge and one end edge against said pin, the spine member of the cover will be centered beneath the edge surface of the stack of sheets when the stack of sheets is positioned with one side surface against the guide surface of said alignment plate.

7. A device according to claim 6 wherein said means for visually indicating the proper size of cover which may be properly used with a stack of sheets having a given thickness comprises an indication of cover sizes on said gauge plate, with each indication being positioned adjacent a different one of said second surface portions.

* * * * *